US010026534B2

(12) United States Patent
Toda et al.

(10) Patent No.: US 10,026,534 B2
(45) Date of Patent: Jul. 17, 2018

(54) HOT-ROLLED STEEL SHEET FOR PRODUCING NON-ORIENTED ELECTRICAL STEEL SHEET AND METHOD OF PRODUCING SAME

(71) Applicant: JFE STEEL CORPORATION, Tokyo (JP)

(72) Inventors: Hiroaki Toda, Kurashiki (JP); Yoshiaki Zaizen, Kurashiki (JP); Tadashi Nakanishi, Kurashiki (JP); Yoshihiko Oda, Fukuyama (JP)

(73) Assignee: JFE STEEL CORPORATION, Tokyo (JP)

( * ) Notice: Subject to any disclaimer, the term of this patent is extended or adjusted under 35 U.S.C. 154(b) by 106 days.

(21) Appl. No.: 14/759,891

(22) PCT Filed: Jan. 16, 2014

(86) PCT No.: PCT/JP2014/000200
§ 371 (c)(1),
(2) Date: Jul. 8, 2015

(87) PCT Pub. No.: WO2014/129106
PCT Pub. Date: Aug. 28, 2014

(65) Prior Publication Data

US 2015/0348686 A1 Dec. 3, 2015

(30) Foreign Application Priority Data

Feb. 22, 2013 (JP) ..... 2013-033387

(51) Int. Cl.
*C21D 8/12* (2006.01)
*C22C 38/02* (2006.01)
(Continued)

(52) U.S. Cl.
CPC ..... *H01F 1/14775* (2013.01); *B21B 3/02* (2013.01); *C21D 6/005* (2013.01); *C21D 6/008* (2013.01);
(Continued)

(58) Field of Classification Search
CPC ..... C22C 38/02; C22C 38/04; C22C 38/06; C21D 8/12
(Continued)

(56) References Cited

U.S. PATENT DOCUMENTS 5,062,905 A 11/1991 Tomita et al.
2004/0016530 A1* 1/2004 Schoen ..... C21D 8/1211 164/476
(Continued)

FOREIGN PATENT DOCUMENTS

CA 2266825 A1 9/2000
CN 101084322 A 12/2007
(Continued)

OTHER PUBLICATIONS

Oct. 21, 2016 Office Action in Canadian Patent Application No. 2,897,921.
(Continued)

*Primary Examiner* — Brian Walck
(74) *Attorney, Agent, or Firm* — Oliff PLC

(57) ABSTRACT

By using a hot-rolled steel sheet of a predetermined chemical composition, and annealing the hot-rolled steel sheet in nitrogen atmosphere at 1000° C. for 30 seconds, and then immersing in a solution of 7% HCl at 80° C. for 60 seconds to obtain a hot-rolled steel sheet having a pickling weight loss of 10 g/m$^2$ or more and 35 g/m$^2$ or less, it is possible to obtain a hot-rolled steel sheet for producing a non-oriented electrical steel sheet that not only has excellent magnetic properties such as iron loss properties and magnetic flux
(Continued)

density, but also has reduced steel sheet surface defects and an excellent manufacturing yield.

3 Claims, 4 Drawing Sheets

(51) Int. Cl.

| | |
|---|---|
| ***C22C 38/04*** | (2006.01) |
| ***C22C 38/06*** | (2006.01) |
| ***H01F 1/147*** | (2006.01) |
| ***C21D 6/00*** | (2006.01) |
| ***C21D 9/46*** | (2006.01) |
| ***C22C 38/12*** | (2006.01) |
| ***C22C 38/00*** | (2006.01) |
| ***H01F 41/02*** | (2006.01) |
| ***B21B 3/02*** | (2006.01) |
| ***C22C 38/60*** | (2006.01) |
| ***H01F 1/16*** | (2006.01) |

(52) U.S. Cl.
CPC ..... *C21D 8/12* (2013.01); *C21D 8/1222* (2013.01); *C21D 8/1255* (2013.01); *C21D 8/1261* (2013.01); *C21D 9/46* (2013.01); *C22C 38/00* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/12* (2013.01); *C22C 38/60* (2013.01); *H01F 1/16* (2013.01); *H01F 41/02* (2013.01); *H01F 1/14791* (2013.01)

(58) Field of Classification Search
USPC ..... 148/320, 334; 420/84, 123
See application file for complete search history.

(56) References Cited

U.S. PATENT DOCUMENTS

| | | | |
|---|---|---|---|
| 2008/0121314 | A1 | 5/2008 | Choi et al. |
| 2009/0202383 | A1 | 8/2009 | Tanaka et al. |
| 2011/0042625 | A1 | 2/2011 | Tanaka et al. |
| 2012/0131982 | A1 | 5/2012 | Imamura et al. |

FOREIGN PATENT DOCUMENTS

| | | | | | |
|---|---|---|---|---|---|
| CN | 101218362 | A | | 7/2008 | |
| CN | 102471850 | A | | 5/2012 | |
| EP | 0589415 | | * | 9/1993 | ..... C21D 9/48 |
| JP | S56-54370 | B2 | | 12/1981 | |
| JP | S58-3027 | B2 | | 1/1983 | |
| JP | S58-181822 | A | | 10/1983 | |
| JP | H02-61031 | A | | 3/1990 | |
| JP | H02-50190 | B2 | | 11/1990 | |
| JP | H03-294422 | A | | 12/1991 | |
| JP | H07-62174 | B2 | | 7/1995 | |
| JP | H07-62175 | B2 | | 7/1995 | |
| JP | 2984185 | B2 | | 11/1999 | |
| JP | 2002-294417 | A | | 10/2002 | |
| JP | 2003-293101 | A | | 10/2003 | |
| JP | 2005-126748 | A | | 5/2005 | |
| JP | 2008-156737 | A | | 7/2008 | |
| JP | 4258164 | B2 | | 4/2009 | |
| JP | 2012-149337 | A | | 8/2012 | |
| JP | 2013-010982 | A | | 1/2013 | |
| JP | 2013-091837 | A | | 5/2013 | |
| WO | 2004/101831 | A1 | | 11/2004 | |

OTHER PUBLICATIONS

May 4, 2016 Search Report issued in European Patent Application No. 14753500.9.
May 5, 2016 Office Action issued in Chinese Patent Application No. 201480009330.5.
Apr. 22, 2014 International Search Report issued in International Patent Application No. PCT/JP2014/000200.
Mar. 16, 2015 Office Action issued in Taiwanese Patent Application No. 103105381.

* cited by examiner

HOT-ROLLED STEEL SHEET FOR PRODUCING NON-ORIENTED ELECTRICAL STEEL SHEET AND METHOD OF PRODUCING SAME

TECHNICAL FIELD

This disclosure relates to a hot-rolled steel sheet for producing a non-oriented electrical steel sheet mainly used as an iron core material of electrical appliances and a method of producing the same, and in particular, to a hot-rolled steel sheet for producing a non-oriented electrical steel sheet that not only has excellent magnetic properties such as iron loss properties and magnetic flux density, but also has reduced steel sheet surface defects and an excellent manufacturing yield, and a method of producing the same.

BACKGROUND

In recent years, with the global movement of saving energy including electricity, there is a strong demand for higher efficiency in electric appliances, and an even lower iron loss is desired for non-oriented electrical steel sheets used in iron core materials as well. Therefore, various proposals have been made for iron loss reducing techniques for non-oriented electrical steel sheets.

As a measure to reduce iron loss of non-oriented electrical steel sheets, a means of increasing the content of Si, Al, Mn, or the like in steel to increase electric resistance and reduce eddy current loss, is generally used. However, if the addition amounts of Si, Al or the like are increased for the purpose of further improving iron loss properties of the current high-grade products, not only problems relating to manufacturability such as rolling, but also a disadvantage of causing an increase in material costs is caused.

JPH0250190B (PTL 1) discloses a technique of reducing iron loss by reducing the content of impurity elements (S, N, and O) in steel. Further, JP2984185B (PTL 2) discloses a method of suppressing mixture of impurities and defining the slab heating temperature, the coiling temperature, the hot band annealing condition, the cold rolling reduction ratio, and the final annealing condition to control inclusions and reduce iron loss.

Further, some methods of modifying the production process to improve the crystal orientation distribution in the product sheets, i.e. the texture thereof to enhance magnetic properties, have been proposed. For example, JPS58181822A (PTL 3) discloses a method of subjecting a steel containing Si: 2.8 mass % to 4.0 mass % and Al: 0.3 mass % to 2.0 mass % to warm rolling in a temperature range of 200° C. to 500° C. to develop {100}<0VW> textures. Further, JPH03294422A (PTL 4) discloses a method of subjecting a steel containing Si: 1.5 mass % to 4.0 mass % and Al: 0.1 mass % to 2.0 mass % to hot rolling, and then performing hot band annealing at 1000° C. or higher and 1200° C. or lower in combination with cold rolling at a rolling reduction ratio of 80% to 90% to develop {100} textures.

Further, JPS5654370B (PTL 5), JPS583027B (PTL 6), and JP4258164B (PTL 7) propose a technique of containing a small amount of Sn or Sb to reduce iron loss.

CITATION LIST

Patent Literature

PTL 1: JPH0250190B
PTL 2: JP2984185B
PTL 3: JPS58181822A
PTL 4: JPH03294422A

PTL 5: JPS5654370B
PTL 6: JPS583027B
PTL 7: JP4258164B

SUMMARY

By using the above mentioned techniques (PTLs 1 to 7), iron loss can indeed be reduced. However, particularly in recent years, when a small amount of Sn or Sb are added, many surface defects frequently occur in the steel sheets to significantly deteriorate the manufacturing yield.

This disclosure has been developed in view of the circumstances described above, and has an object of providing a hot-rolled steel sheet for producing a non-oriented electrical steel sheet that not only has excellent magnetic properties such as iron loss properties and magnetic flux density, but also has reduced steel sheet surface defects and an excellent manufacturing yield, together with an advantageous method of producing the same.

We carried out various investigations in order to identify the cause of the increase of surface defects on steel sheets, and discovered that depending on the difference of place of origin, vein or the like, the impurity quantity of Pb and Bi contained in raw materials of Sn or Sb varies, and when the total content of Pb and Bi exceeds 0.0010 mass %, many surface defects occur.

Having investigated the cause of the above phenomenon, we found that since the composition disclosed herein contains Al of 0.2 mass % or more, when the total content of Pb and Bi is 0.0010 mass % or less, a barrier effect obtained from Al oxides generated at the time of hot band annealing inhibits the generation of $SiO_2$ scales and then in the subsequent pickling, scales are removed in a relatively uniform manner, and surface appearance of the final annealed steel sheet is improved. On the other hand, we inferred that, when the total content of Pb and Bi exceeds 0.0010 mass %, the barrier effect obtained from Al oxides generated at the time of hot band annealing partially weakens and facilitates oxidization of Si, and on a micro level, the amount of resulting $SiO_2$ largely varies and causes a large variation in the degree of scale removal by the subsequent pickling and leads to non-uniformity in the surface of the final annealed steel sheet to deteriorate the appearance.

Further, we inferred that the Pb and Bi contained in steel melts when performing slab heating, hot rolling, hot band annealing or final annealing and leads to an increase in surface defects.

We conducted further investigation and discovered that when the total content of Pb and Bi is 0.0010 mass % or less, it is possible to significantly inhibit generation of surface defects by setting P content to 0.015 mass % or less, and Mo content to 0.002 mass % or more and 0.03 mass % or less. Further, if P content increases, pickling loss increases in pickling performed after hot band annealing in order to remove scales. Although this would improve the pickling property of the steel sheet, it was revealed that, with the composition disclosed herein, it promotes non-uniformity in the degree of scale removal. Further, we discovered that, since P is inevitably mixed in steel as an impurity in an amount of around 0.01 mass %, in order to reduce the influence thereof, it is effective to set Mo content to the above range.

This disclosure was completed based on these findings.

We thus provide:

1. A hot-rolled steel sheet for producing a non-oriented electrical steel sheet, having a chemical composition containing by mass %, C: 0.005% or less, Si: 2.0% or more and 4.5% or less, Al: 0.2% or more and 2.0% or less, Mn: 0.1% or more and 2.0% or less, S: 0.003% or less, N: 0.003% or less, P: 0.015% or less, Mo: 0.002% or more and 0.03% or less, Pb and Bi in a total of 0.0010% or less, one or both of Sn and Sb in a total of 0.005% or more and 0.2% or less, and the balance Fe with inevitable impurities, wherein the hot-rolled steel sheet has a pickling weight loss of 10 $g/m^2$ or more and 35 $g/m^2$ or less after annealing in nitrogen atmosphere at 1000° C. for 30 seconds, and then immersed in a solution of 7% HCl at 80° C. for 60 seconds.

2. The hot-rolled steel sheet for producing a non-oriented electrical steel sheet according to aspect 1, wherein the chemical composition further contains by mass %, one or more of Ca: 0.001% or more and 0.005% or less, Mg: 0.0002% or more and 0.005% or less, Cr: 0.05% or more and 0.5% or less.

3. A method of producing a hot-rolled steel sheet for producing a non-oriented electrical steel sheet, the method comprising:

heating a slab having a chemical composition containing by mass %, C: 0.005% or less, Si: 2.0% or more and 4.5% or less, Al: 0.2% or more and 2.0% or less, Mn: 0.1% or more and 2.0% or less, S: 0.003% or less, N: 0.003% or less, P: 0.015% or less, Mo: 0.002% or more and 0.03% or less, Pb and Bi in a total of 0.0010% or less, one or both of Sn and Sb in a total of 0.005% or more and 0.2% or less, and the balance Fe with inevitable impurities;

then subjecting the slab to hot rolling to obtain a hot-rolled steel sheet;

then coiling the hot-rolled steel sheet, wherein the slab heating temperature is 1050° C. or higher and 1150° C. or lower, and the finishing delivery temperature of the hot rolling is 820° C. or higher and 920° C. or lower, and the coiling temperature after the hot rolling is 520° C. or higher and 620° C. or lower.

4. The method of producing a hot-rolled steel sheet for producing a non-oriented electrical steel sheet according to aspect 3, wherein the chemical composition further contains by mass %, one or more of Ca: 0.001% or more and 0.005% or less, Mg: 0.0002% or more and 0.005% or less, and Cr: 0.05% or more and 0.5% or less.

A hot-rolled steel sheet for producing a non-oriented electrical steel sheet with low iron loss and few surface defects on the steel sheet can be provided together with an advantageous method of producing the same.

DETAILED DESCRIPTION

Our products and methods will be described in detail below. Note that the percentages indicated in the steel sheet composition listed below represent mass % unless otherwise specified.

First, reference will be made to the experimental results based on which the disclosure has been completed.

For the investigation on the influence of Pb on iron loss properties and surface appearance, a composition containing C: 0.0023%, Si: 2.5%, Al: 0.3%, Mn: 0.2%, S: 0.0021%, N: 0.0015%, Sn: 0.05%, and P: 0.03% was defined as the A series, and a composition containing C: 0.0021%, Si: 2.5%, Al: 0.3%, Mn: 0.2%, S: 0.0017%, N: 0.0020%, Sn: 0.05%, P: 0.01%, and Mo: 0.005% was defined as the B series. Steel samples of both compositions with Pb added in a range of 0 to 0.01% were melted in a laboratory, heated at 1100° C., and then subjected to hot rolling until reaching a thickness of 2.2 mm. Then, the hot-rolled steel sheets were subjected to hot band annealing in an atmosphere of 100% $N_2$ at 1000° C. for 30 seconds. Subsequently, the steel sheets were subjected to pickling in a solution of 7% HCl at 80° C. for 1 minute, and then to cold rolling until reaching a sheet thickness of 0.50 mm, and then final annealing in an atmosphere of 20% $H_2$-80% $N_2$ at 1000° C. for 10 seconds. Hot-rolled sheet test pieces before pickling were collected separately from those subjected to the above processes.

Epstein test pieces were cut from each of the resulting steel sheets in the rolling direction (L direction) and a direction orthogonal to the rolling direction (C direction) to measure their magnetic properties. The magnetic properties were evaluated based on L+C property. Investigation on surface appearance was also performed. The investigation results on iron loss $W_{15/50}$ and surface defects are shown in FIG. 1.

Figure 1:
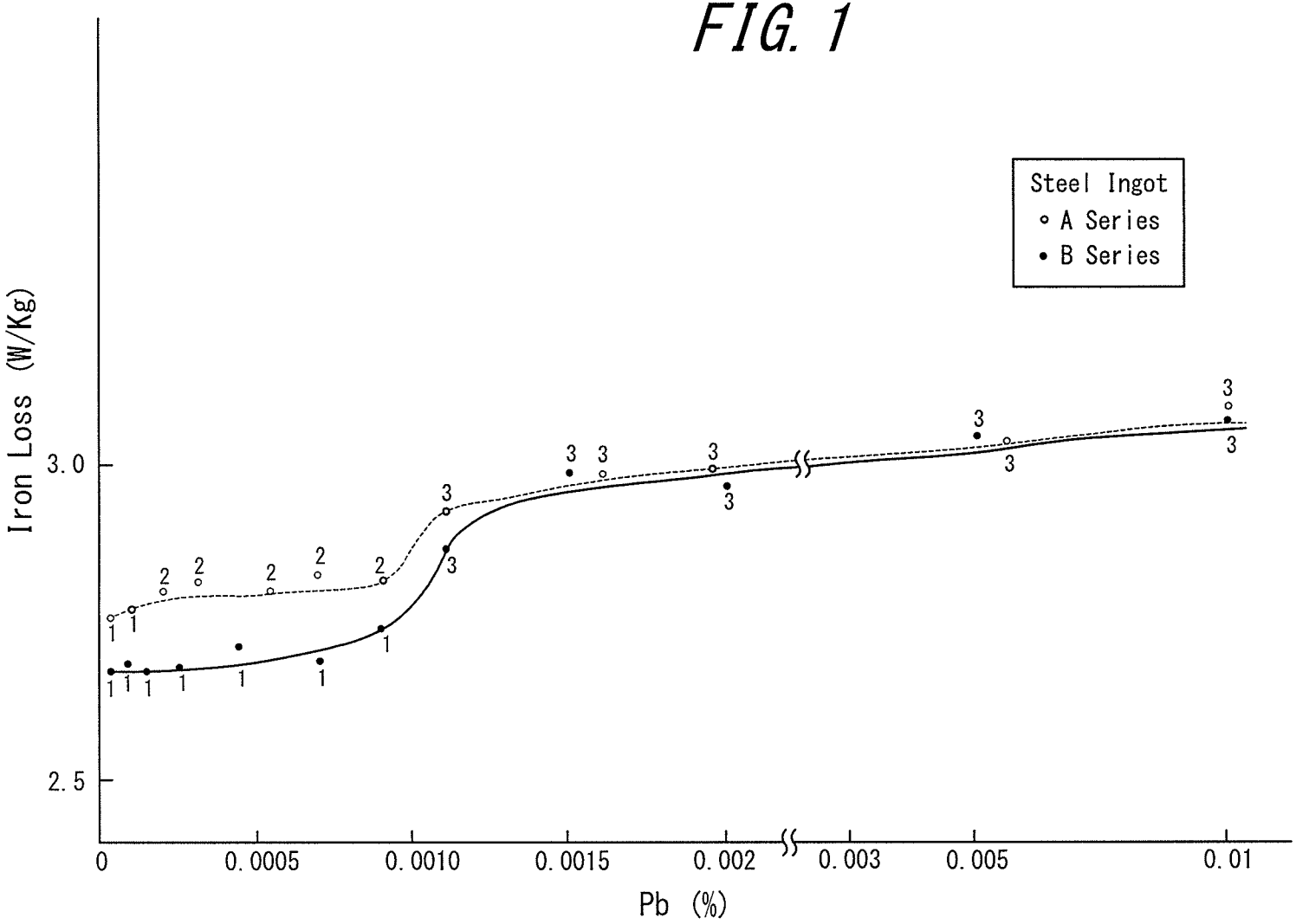
FIG. 1 shows a graph of the results of investigating the relation between iron loss $W_{15/50}$ and Pb content of hot-rolled sheet test pieces and the influence thereof on the surface appearance.

The occurrence state of surface defects was evaluated by the length of linear defects existing per unit area of the steel sheet, and a length of less than 0.001 ($m/m^2$) was evaluated as having no defects (indicated as 1 in FIG. 1), a length of 0.001 ($m/m^2$) or more and 0.01 ($m/m^2$) or less as having few defects (indicated as 2 in FIG. 1), a length exceeding 0.01 ($m/m^2$) as having many defects (indicated as 3 in FIG. 1).

FIG. 1 shows that, with both compositions of the A series and the B series, when the Pb content exceeds 0.0010%, surface appearance significantly deteriorates and iron loss properties also has a tendency to deteriorate. However, if the Pb content is 0.0010% or less, the steel having a composition of the B series tended to show better iron loss properties and surface appearance compared to the steel having a composition of the A series.

To further investigate the above test results, hot-rolled sheet test pieces before pickling which were collected separately were used to investigate the pickling weight loss of steel sheets subjected to pickling in a solution of 7% HCl at 80° C. for 60 seconds. The pickling weight loss of this disclosure: Δm can be obtained using the following formula (1).

$$\Delta m=(m_1-m_2)/S \quad (1)$$

Δm: pickling weight loss ($g/m^2$)

$m_1$: mass before pickling (g)

$m_2$: mass after pickling (g)

S: sample area ($m^2$)

Figure 2:
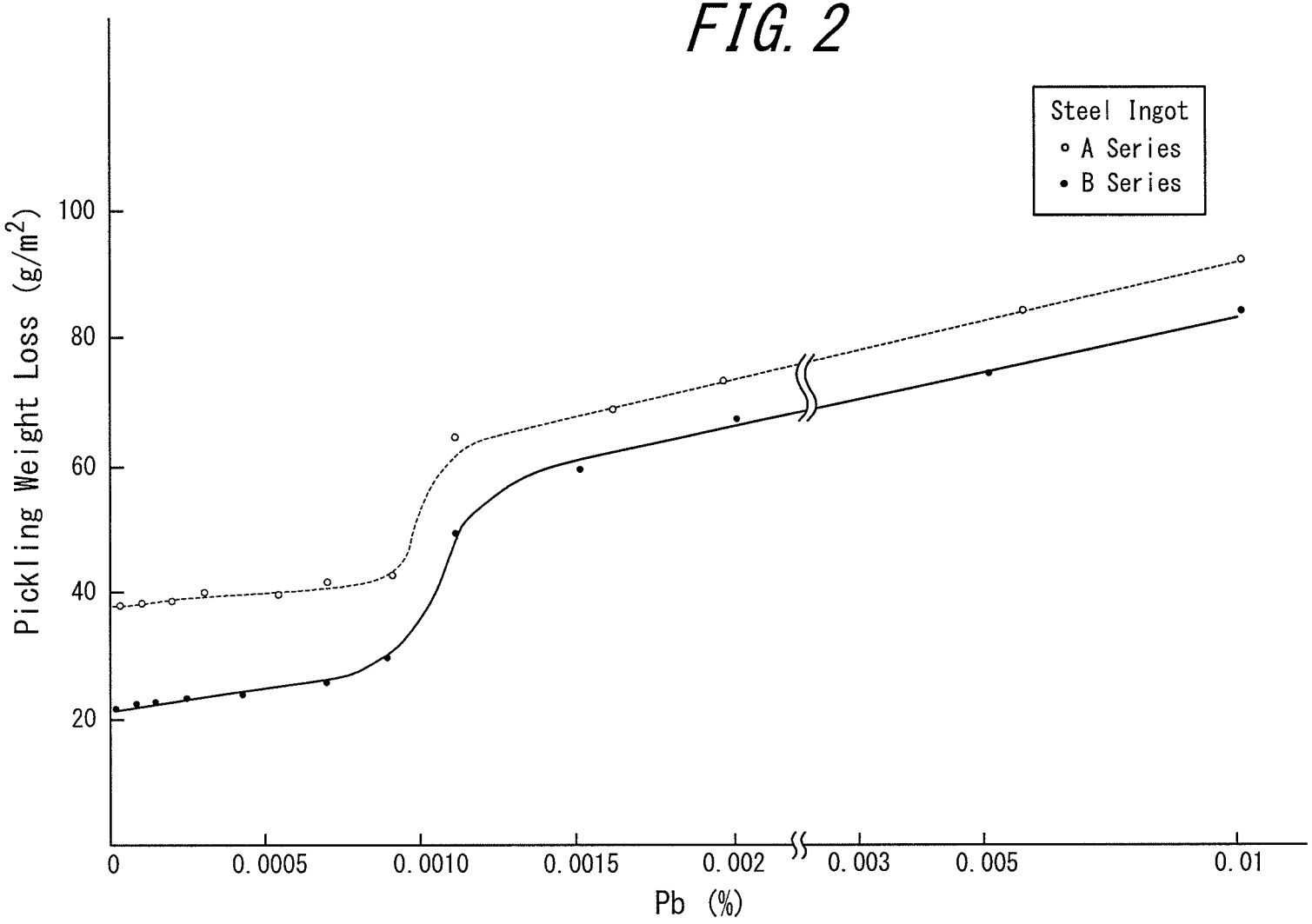
FIG. 2 shows a graph of the relation between Pb content of hot-rolled sheet test pieces and pickling weight loss.

The results are shown in FIG. 2. FIG. 2 shows that if Pb content exceeds 0.0010%, the pickling weight loss increases. Further, it is shown that, if Pb content is 0.0010% or less, the steel having a composition of the B series shows less pickling weight loss than the steel having a composition of the A series.

The same experiment was conducted for cases where Sb was added instead of Sn, with Bi content varied in a range of 0 to 0.01%. Here, when Bi exceeded 0.0010%, surface defects and iron loss properties tended to deteriorate and pickling weight loss of the hot-rolled sheet increased, which was the same result for the case using Sn.

Next, an investigation was made for the optimum addition amount of P and Mo when the total content of Pb and Bi is 0.0010% or less.

In particular, steel samples containing C: 0.0030%, Si: 3.5%, Al: 1.0%, Mn: 0.5%, S: 0.0012%, N: 0.0017%, Sn: 0.03%, Pb: 0.0002%, and P varied in a range of 0.005% to 0.05% and Mo varied in a range of 0 to 0.1% were melted in a laboratory, heated at 1100° C., and then subjected to hot rolling until reaching a thickness of 1.8 mm. Then, the hot-rolled steel sheets were subjected to hot band annealing in an atmosphere of 100% $N_2$ at 1000° C. for 30 seconds, and then pickling by immersing the steel sheets in a solution of 7% HCl at 80° C. for 60 seconds, and then the steel sheets were subjected to cold rolling until reaching a sheet thickness of 0.35 mm, and then final annealing in an atmosphere of 20% $H_2$-80% $N_2$ at 1025° C. for 10 seconds. Samples after hot band annealing before and after pickling were collected separately, and pickling weight loss thereof was investigated.

Figure 3:
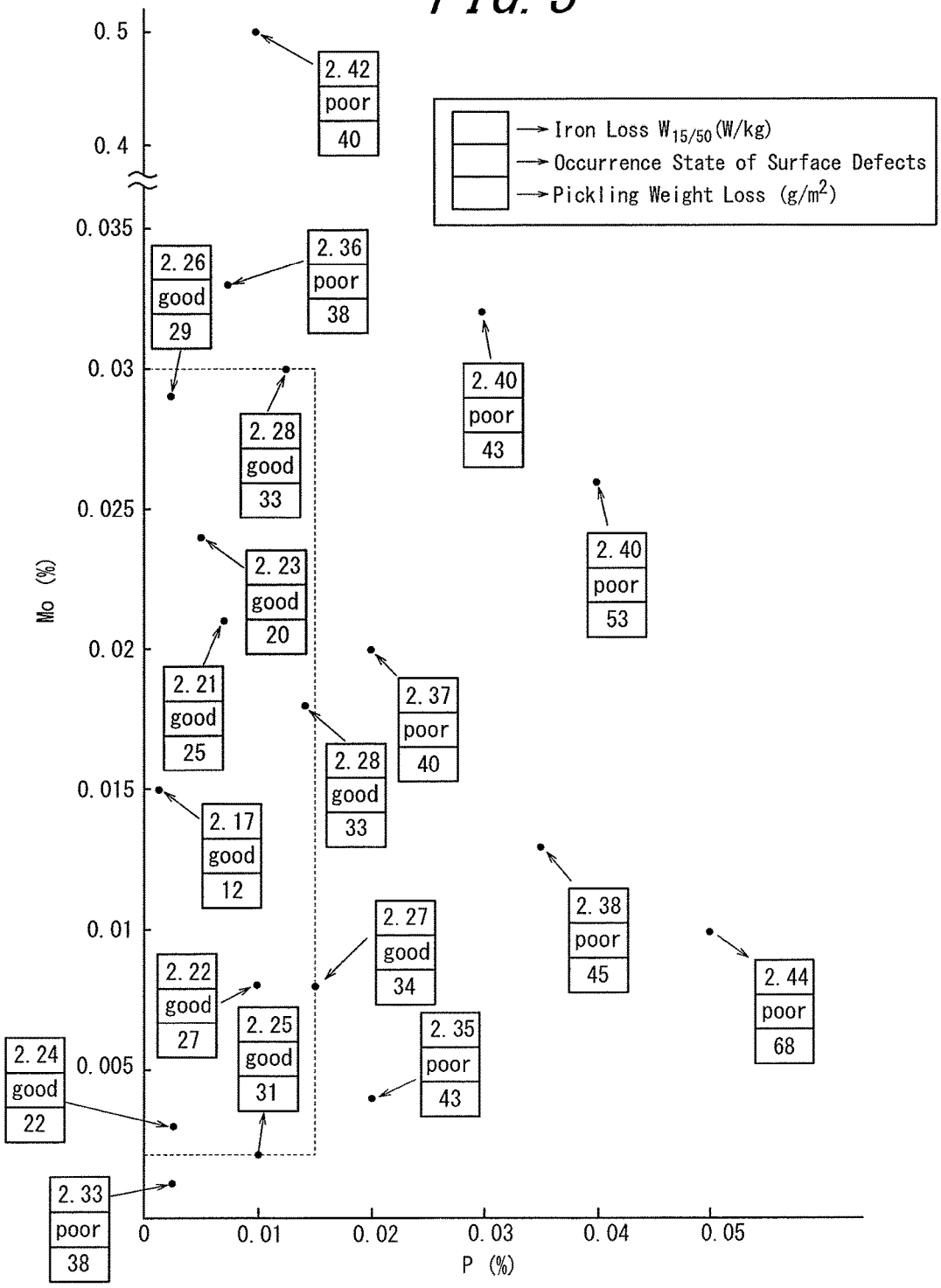
FIG. 3 shows a graph of the results of investigating iron loss $W_{15/50}$, pickling weight loss and surface appearance depending on the amount of P and Mo added to sample materials.

Epstein test pieces were cut from each of the resulting steel sheets in the rolling direction and a direction orthogonal to the rolling direction to measure their magnetic properties. The magnetic properties were evaluated based on L+C property. Investigation on the occurrence state of surface defects was also performed. The influence of P, Mo addition amounts on iron loss, occurrence state of surface defects, and pickling weight loss of the hot-rolled sheets after immersing in a solution of 7% HCl at 80° C. for 60 seconds is shown in FIG. 3. The occurrence state of surface defects was evaluated by the length of linear defects existing per unit area of the steel sheet, and length of less than 0.001 ($m/m^2$) was evaluated as not defective (Good), length of 0.001 ($m/m^2$) or more was evaluated as defective (Poor).

FIG. 3 shows that, for samples containing P of 0.015% or less and Mo in a range of 0.002% to 0.03%, surface appearances are enhanced and iron loss properties are improved. Further, for samples after hot band annealing with addition content of P and Mo in the above ranges, the pickling weight loss after immersing in a solution of 7% HCl at 80° C. for 60 seconds, was in a range of 10 $g/m^2$ or more and 35 $g/m^2$ or less.

Further, investigation on producing conditions for obtaining a hot-rolled steel sheet with good magnetic properties and surface appearance was performed.

Steel slabs having a chemical composition containing C: 0.0012%, Si: 3.0%, Al: 0.5%, Mn: 0.5%, S: 0.0008%, N: 0.003%, Sn: 0.08%, Pb: 0.0003%, P: 0.01% and Mo: 0.01% were prepared, and subjected to hot rolling until reaching a thickness of 2.0 mm with varied slab heating temperatures, finishing delivery temperatures, and coiling temperatures after hot rolling. Then, the hot-rolled sheets were subjected to hot band annealing in nitrogen atmosphere at 1000° C. for 30 seconds, and then pickling by immersing in a solution of 7% HCl at 80° C. for 60 seconds, and then cold rolling until reaching a sheet thickness of 0.35 mm. Subsequently, the steel sheets were subjected to final annealing in an atmosphere of 20% $H_2$ to 80% $N_2$ at 1010° C. for 10 seconds.

Epstein test pieces were cut from each of the resulting steel sheets in the rolling direction and a direction orthogonal to the rolling direction to measure their magnetic properties. The magnetic properties were evaluated based on L+C property. Investigation on the occurrence state of surface defects was also performed. The occurrence state of surface defects was evaluated by the length of linear defects existing per unit area of the steel sheet, and a length of less than 0.001 ($m/m^2$) was evaluated as not defective (Good), a length of 0.001 ($m/m^2$) or more as defective (Poor).

Figure 4:
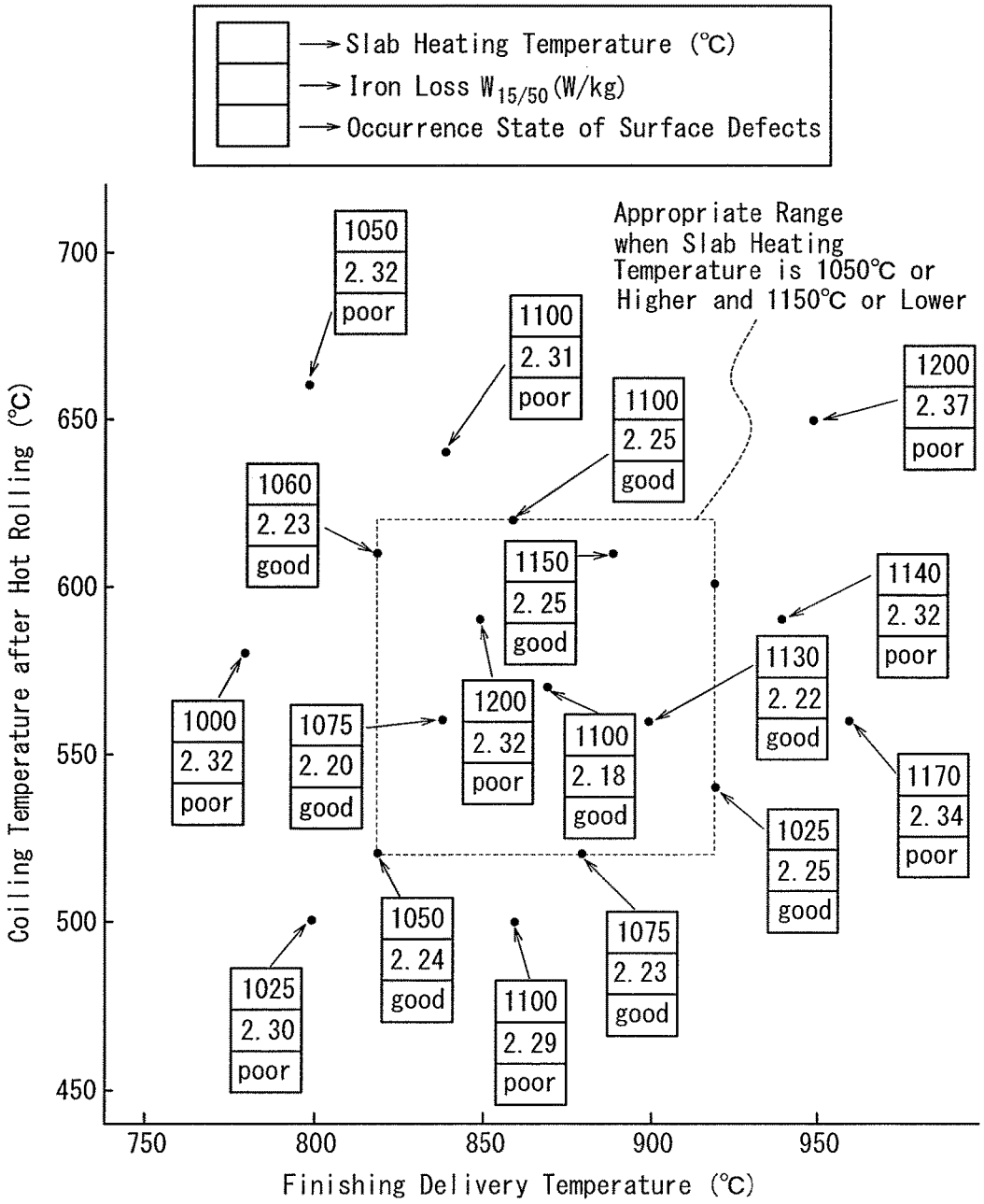
FIG. 4 shows a graph of the influence of slab heating temperature, finishing delivery temperature and coiling temperature after hot rolling on iron loss $W_{15/50}$ and surface appearance.

The influence of slab heating temperature, finishing delivery temperature, and coiling temperature after hot rolling, on iron loss $W_{15/50}$ and the occurrence state of surface defects is shown in FIG. 4.

FIG. 4 shows that when the slab heating temperature is in the range of 1050° C. or higher and 1150° C. or lower, and the finishing delivery temperature is in the range of 820° C. or higher and 920° C. or lower, and the coiling temperature after hot rolling is in the range of 520° C. or higher and 620° C. or lower, an iron loss reducing effect and a good surface appearance are both achieved. Further, for samples subjected to hot band annealing under the above appropriate ranges, the pickling weight loss after immersing in a solution of 7% HCl at 80° C. for 60 seconds was in a range of 10 $g/m^2$ or more and 35 $g/m^2$ or less.

Here, although the reason that the defects on the steel sheet surface are reduced when controlling the slab heating temperature, the finishing delivery temperature and the coiling temperature after hot rolling to the above ranges is not necessarily clear, it is believed that, when Pb content is 0.0010% or less, by satisfying the above temperature ranges at the time of adding Sn, P and Mo, forms and textures of oxide scales generated on the hot-rolled steel sheet is made advantageous in terms of removing them in the following processes.

The reasons for limiting the ranges of the chemical compositions as described above are as follows.

C: 0.005% or less

In order to make the steel sheet less susceptible to magnetic aging, C content is preferably kept as low as possible. However, a content thereof of up to 0.005% would be tolerable. The content is preferably 0.0035% or less.

Si: 2.0% or more and 4.5% or less

In the electrical steel sheet of the disclosure, Si is a useful element for increasing electrical resistance and improving iron loss properties. In order to obtain such effect of improving iron loss properties, Si content of 2.0% or more is required. On the other hand, if Si content exceeds 4.5%, the workability of the steel sheet deteriorates, and the decrease in magnetic flux density becomes prominent. Therefore, Si content is limited to a range of 2.0% to 4.5%.

Al: 0.2% or more and 2.0% or less

Al, similarly to Si, is commonly used as a deoxidizer for steel and has a large effect of increasing electrical resistance and reducing iron loss, and therefore, it is normally used as one of the main elements contained in a non-oriented electrical steel sheet. Further, Al is effective for reducing the amount of AlN-based precipitates (fine precipitates), and for that, it is necessary for the addition amount to be 0.2% or more. However, if the content thereof is excessive, the lubricity with mold in continuous casting decreases, and makes casting difficult, and therefore Al is contained in an amount of 2.0% or less.

Mn: 0.1% or more and 2.0% or less

Mn, similarly to Si, provides an effect of increasing electrical resistance and reducing iron loss. Further, it is an effective element for improving hot rolling manufacturability. However, if the content thereof is less than 0.1%, the addition effect is limited. On the other hand, if it exceeds 2.0%, the decrease in saturation magnetic flux density becomes prominent. Therefore, Mn content is limited to the above range.

S: 0.003% or less

S is an impurity that is inevitably mixed in steel, and as the content thereof increases, a large amount of sulfide inclusions will be formed and become the cause of an increase in iron loss. Therefore, S content is 0.003% or less in this disclosure. On the other hand, there is no particular lower limit. However, from the viewpoint of productivity or the like, the lower limit is around 0.0002%.

N: 0.003% or less

N, similarly to S, is an impurity that is inevitably mixed in steel, and if the content thereof is large, a large amount of nitrides will be formed and become the cause of an increase in iron loss. Therefore, N content is 0.003% or less in this disclosure. On the other hand, there is no particular lower limit. However, from the viewpoint of productivity or the like, the lower limit is around 0.0005%.

P: 0.015% or less

P is an element that is often intentionally added for enhancing strength and improving textures of the steel sheet. However, in this disclosure, for the purpose of improving surface appearance of the steel sheet, it is necessary to be kept as low as possible, and therefore P content is 0.015% or less. On the other hand, there is no particular lower limit. However, from the viewpoint of productivity or the like, the lower limit is around 0.002%.

Mo: 0.002% or more and 0.03% or less

In this disclosure, Mo is an essential element for reducing the adverse effect of P of around 0.01% which is inevitably mixed in steel as an impurity, on surface appearance. If the content thereof is less than 0.002%, a sufficient addition effect cannot be obtained. On the other hand, if Mo is added in an amount exceeding 0.03%, it tends to adversely affect magnetic properties. Therefore, the content thereof is limited to the above range. The content is preferably 0.003% or more and 0.02% or less.

Sn and Sb: 0.005% or more and 0.2% or less

Sn and Sb both have an effect of improving the texture and enhancing magnetic properties of the non-oriented electrical steel sheet. To obtain this effect, Sb and Sn are added in a total amount of 0.005% or more, whether these elements are added alone or in combination. On the other hand, excessively adding these elements would cause embrittlement of steel, and increase sheet fracture and occurrence of defects such as scabs during the production of the steel sheet. Therefore, the total content of Sn and Sb is 0.2% or less, whether these elements are added alone or in combination.

Pb and Bi: 0.0010% or less (in total)

Whether Pb and Bi are added alone or in combination, if the total content exceeds 0.0010%, the surface appearance of the steel sheet significantly deteriorates, and magnetic properties deteriorate as well. Therefore, the total content of these elements is limited to the above range. On the other hand, there is no particular lower limit. However, from the viewpoint of productivity or the like, the lower limit is around 0.00001% (0.1 mass ppm).

In this disclosure, the following elements may be contained as appropriate in addition to the above basic components in order to enhance magnetic properties, and improve surface characteristics of the non-oriented electrical steel sheet.

Ca: 0.001% or more and 0.005% or less Ca is an effective element which precipitates as CaS and inhibits precipitation of fine sulfides to improve iron loss properties. However, if the content thereof is less than 0.001%, the addition effect is not sufficient. On the other hand, Ca content exceeding 0.005% increases inclusions of Ca oxides, and deteriorates iron loss properties. Therefore, when adding Ca, the content thereof is preferably in the above range.

Mg: 0.0002% or more and 0.005% or less

When 0.0002% or more of Mg is added, Mg oxides are formed, and in these oxides, impurity elements such as S and N compositely precipitate and inhibit generation of harmful sulfides and nitrides to deteriorate iron loss properties. Therefore, the lower limit of Mg content is preferably 0.0002%.

On the other hand, adding Mg in an amount exceeding 0.005% is difficult in terms of productivity, and would unnecessarily cause an increase in costs. Therefore, the upper limit of Mg content is preferably around 0.005%.

Cr: 0.05% or more and 0.5% or less

Cr is an effective element for improving iron loss properties and surface appearance by modifying surface layer scales generated during hot rolling and hot band annealing, and by adding in an amount of 0.05% or more, the effect becomes apparent. However, if Cr content exceeds 0.5%, the effect reaches a plateau. Therefore, when adding Cr, the content thereof is preferably limited to a range of 0.05% or more and 0.5% or less.

The balance other than the above-described elements is Fe and inevitable impurities that are mixed during the production process.

Next, the reasons for limiting various conditions and the like in the method of producing the hot-rolled steel sheet according to the disclosure are described.

When producing a non-oriented electrical steel sheet using the hot-rolled steel sheet of the disclosure, the process and equipment applied for a normal non-oriented electrical steel sheet can be used, except for the production conditions of the hot-rolled steel sheet described later.

For example, a steel which is obtained by steelmaking in a converter or an electric furnace so as to have a predetermined chemical composition is subjected to secondary refining in a degassing equipment, and to continuous casting or to blooming after ingot casting to obtain a steel slab, and then the steel slab is subjected to hot rolling to obtain a hot-rolled steel sheet according to the disclosure.

Then, by subjecting the hot-rolled steel sheet to hot band annealing, pickling, cold or warm rolling, final annealing and applying and baking insulating coating thereon, a non-oriented electrical steel sheet is obtained.

In this disclosure, in order to reduce surface defects of the steel sheet and maintain a good manufacturing yield, it is necessary to control the production conditions of the hot-rolled steel sheet as described below.

In particular, the slab heating temperature is set to 1050° C. or higher and 1150° C. or lower, and hot rolling is performed so that the finishing delivery temperature is in a range of 820° C. or higher and 920° C. or lower, and the coiling temperature after hot rolling is in a range of 520° C. or higher and 620° C. or lower.

Further, the preferable range of the slab heating temperature is 1050° C. or higher and 1125° C. or lower, the preferable range of the finishing delivery temperature is 850° C. or higher and 900° C. or lower, and the preferable range of the coiling temperature after hot rolling is 550° C. or higher and 600° C. or lower.

By performing the hot rolling process under these conditions, together with the effects obtained by the aforementioned material components such as Mo, the degree of removal of scales generated in the surface layer part of the steel sheet after hot band annealing becomes optimum. In this disclosure, in order to specify the degree of scale removal, representative hot band annealing conditions and pickling conditions were taken into consideration, and the steel sheet was subjected to annealing in nitrogen atmosphere at 1000° C., for 30 seconds, and then the steel sheet was immersed in a solution of 7% HCl at 80° C. for 60 seconds, and the pickling weight loss after these processes was used. With this disclosure, it is possible to exhibit a particularly appropriate degree of scale removal where the pickling weight loss is in a range of 10 g/m$^2$ or more and 35 g/m$^2$ or less.

In order to identify a hot-rolled steel sheet with good magnetic properties and surface appearance, based on the properties of the steel sheet, using the above pickling weight loss, the annealing condition was limited as 1000° C. for 30 seconds, and the pickling condition after annealing was limited as immersing in a solution of 7% HCl at 80° C. for 60 seconds. However, in the actual embodiment, hot band annealing conditions (normally, 950° C. or higher and 1100° C. or lower) and scale removal conditions such as the pickling condition can be optionally set depending on the required product properties and occurrence state of scales or the like, and are not restricted to the above conditions.

EXAMPLES

Example 1

Molten steel obtained by blowing in a converter was subjected to degassing treatment and then casting to produce the steel slab with the composition shown in Table 1. Then, at the slab heating temperature, the finishing delivery temperature, and the coiling temperature after hot rolling shown in Table 2, hot rolling was performed until reaching a thickness of 2.0 mm to obtain a hot-rolled steel sheet. Then, the hot-rolled steel sheet was subjected to hot band annealing in 100% $N_2$ atmosphere at 1000° C. for 30 seconds, and then pickling treatment where the steel sheet was immersed in a solution of 7% HCl at 80° C. for 60 seconds, and then the steel sheet was subjected to cold rolling until reaching the sheet thickness shown in Table 2. Then, the cold rolled sheet was subjected to final annealing in an atmosphere of 20% $H_2$-80% $N_2$ at 1035° C. for 10 seconds, and a subsequent coating treatment.

Epstein test pieces were cut from each of the resulting non-oriented electrical steel sheets in the rolling direction and the direction orthogonal to the rolling direction to measure their magnetic properties (iron loss: $W_{15/50}$, magnetic flux density: $B_{50}$). The magnetic properties were evaluated based on L+C property, and investigation on surface appearance was also performed. The obtained results are also shown in Table 2. The occurrence state of surface defects was evaluated based on the length of linear defects existing per unit area of the steel sheet, and length of less than 0.001 (m/m$^2$) was evaluated as not defective (Good), and length of 0.001 (m/m$^2$) or more was evaluated as defective (Poor).

TABLE 1

| Steel No. | C (%) | Si (%) | Al (%) | Mn (%) | S (%) | N (%) | P (%) | Mo (%) | Sb (%) | Sn (%) | Pb (%) | Bi (%) | Ca (%) | Mg (%) | Remarks |
|---|---|---|---|---|---|---|---|---|---|---|---|---|---|---|---|
| A | 0.0025 | 2.84 | 0.29 | 0.21 | 0.0019 | 0.0021 | 0.020 | 0.001 | — | 0.038 | 0.0001 | — | — | — | Comparative Steel |
| B | 0.0032 | 2.78 | 0.31 | 0.17 | 0.0023 | 0.0017 | 0.014 | 0.003 | — | 0.041 | 0.0001 | — | — | — | Conforming Steel |
| C | 0.0021 | 2.85 | 0.87 | 0.19 | 0.0012 | 0.0025 | 0.028 | 0.003 | 0.045 | — | — | 0.0002 | — | — | Comparative Steel |
| D | 0.0015 | 2.82 | 0.93 | 0.23 | 0.0008 | 0.0010 | 0.006 | 0.005 | 0.041 | — | — | 0.0002 | — | — | Conforming Steel |
| E | 0.0012 | 2.15 | 0.27 | 0.20 | 0.0012 | 0.0013 | 0.010 | 0.020 | — | 0.060 | — | 0.0012 | — | — | Comparative Steel |
| F | 0.0014 | 2.18 | 0.25 | 0.15 | 0.0030 | 0.0010 | 0.009 | 0.020 | — | 0.050 | — | 0.0009 | 0.0027 | — | Conforming Steel |
| G | 0.0024 | 3.67 | 0.75 | 0.54 | 0.0020 | 0.0020 | 0.015 | 0.050 | — | 0.028 | 0.0003 | 0.0001 | — | — | Comparative Steel |
| H | 0.0018 | 3.72 | 0.68 | 0.49 | 0.0018 | 0.0030 | 0.012 | 0.005 | — | 0.035 | 0.0003 | 0.0001 | — | 0.0035 | Conforming Steel |

"%" represents "mass %", and the balance is composed of Fe and inevitable impurities.

TABLE 2

| No. | Steel No. | Slab Heating Temp. (° C.) | Finishing Delivery Temperature (° C.) | Coiling Temperature (° C.) | Pickling Weight Loss after Hot Band Annealing (g/m$^2$) | Thickness of Cold Rolled Steel Sheet (mm) | $W_{15/50}$ (W/kg) | $B_{50}$ (T) | Surface Appearance | Remarks |
|---|---|---|---|---|---|---|---|---|---|---|
| 1 | A | 1140 | 920 | 620 | 41 | 0.50 | 2.73 | 1.70 | Poor | Comparative Example |
| 2 | B | 1140 | 920 | 620 | 30 | 0.50 | 2.59 | 1.71 | Good | Example |
| 3 | C | 1060 | 820 | 520 | 47 | 0.50 | 2.59 | 1.69 | Poor | Comparative Example |
| 4 | D | 1060 | 820 | 520 | 13 | 0.50 | 2.45 | 1.70 | Good | Example |
| 5 | E | 1080 | 850 | 550 | 63 | 0.50 | 3.23 | 1.72 | Poor | Comparative Example |
| 6 | F | 1080 | 850 | 550 | 32 | 0.50 | 3.05 | 1.73 | Good | Example |
| 7 | G | 1100 | 870 | 570 | 43 | 0.50 | 2.31 | 1.66 | Poor | Comparative Example |
| 8 | H | 1100 | 870 | 570 | 26 | 0.50 | 2.19 | 1.67 | Good | Example |
| 9 | B | 1030 | 800 | 500 | 45 | 0.35 | 2.33 | 1.69 | Poor | Comparative Example |

TABLE 2-continued

| No. | Steel No. | Slab Heating Temp. (° C.) | Finishing Delivery Temperature (° C.) | Coiling Temperature (° C.) | Pickling Weight Loss after Hot Band Annealing ($g/m^2$) | Thickness of Cold Rolled Steel Sheet (mm) | $W_{15/50}$ (W/kg) | $B_{50}$ (T) | Surface Appearance | Remarks |
|---|---|---|---|---|---|---|---|---|---|---|
| 10 | B | 1110 | 890 | 600 | 27 | 0.35 | 2.21 | 1.70 | Good | Example |
| 11 | D | 1180 | 950 | 650 | 40 | 0.35 | 2.23 | 1.68 | Poor | Comparative Example |
| 12 | D | 1120 | 890 | 600 | 17 | 0.35 | 2.12 | 1.69 | Good | Example |
| 13 | F | 1150 | 930 | 630 | 42 | 0.35 | 2.59 | 1.71 | Poor | Comparative Example |
| 14 | F | 1150 | 910 | 600 | 29 | 0.35 | 2.45 | 1.72 | Good | Example |
| 15 | H | 1050 | 810 | 510 | 40 | 0.35 | 2.08 | 1.65 | Poor | Comparative Example |
| 16 | H | 1050 | 830 | 530 | 21 | 0.35 | 1.95 | 1.66 | Good | Example |

Table 2 shows the values of pickling weight loss after subjecting the steel sheets to hot band annealing at 1000° C. for 30 seconds and then immersing them in a solution of 7% HCl at 80° C. for 60 seconds, and all of our examples were in the range of 10 $g/m^2$ or more and 35 $g/m^2$ or less.

Further, it is clear that the examples obtained under the production conditions of hot-rolled steel sheets according to this disclosure all show good results in both magnetic properties and surface appearance.

Example 2

Molten steel obtained by blowing in a converter was subjected to degassing treatment and then casting to produce the steel slab with the composition shown in Table 3. Then, at the slab heating temperature, the finishing delivery temperature, and the coiling temperature after hot rolling shown in Table 4, hot rolling was performed until reaching a thickness of 1.6 mm. Then, the hot-rolled steel sheet was subjected to hot band annealing in 100% $N_2$ atmosphere at 1000° C. for 30 seconds, and then pickling treatment where the steel was immersed in a solution of 7% HCl at 80° C. for 60 seconds, and then the steel sheet was subjected to cold rolling until reaching the sheet thickness shown in Table 4. Then, the cold rolled sheet was subjected to final annealing in an atmosphere of 20% $H_2$-80% $N_2$ at 1000° C. for 10 seconds, and a subsequent coating treatment.

Epstein test pieces were cut from each of the resulting non-oriented electrical steel sheets in the rolling direction and the direction orthogonal to the rolling direction to measure their magnetic properties (iron loss: $W_{10/400}$, magnetic flux density: $B_{50}$). The magnetic properties were evaluated based on L+C property, and investigation on surface appearance was also' performed. The obtained results are also shown in Table 4. The occurrence state of surface defects was evaluated based on the length of linear defects existing per unit area of the steel sheet, and a length of less than 0.001 ($m/m^2$) was evaluated as not defective (Good), a length of 0.001 ($m/m^2$) or more as defective (Poor).

TABLE 3

| Steel No. | C (%) | Si (%) | Al (%) | Mn (%) | S (%) | N (%) | P (%) | Mo (%) | Sb (%) | Sn (%) | Pb (%) | Bi (%) | Ca (%) | Cr (%) | Remarks |
|---|---|---|---|---|---|---|---|---|---|---|---|---|---|---|---|
| I | 0.0020 | 2.92 | 1.15 | 0.51 | 0.0025 | 0.0018 | 0.033 | 0.005 | 0.021 | 0.033 | 0.0002 | 0.0003 | — | — | Comparative Steel |
| J | 0.0010 | 2.87 | 1.22 | 0.50 | 0.0017 | 0.0020 | 0.011 | 0.005 | 0.023 | 0.035 | 0.0002 | 0.0003 | — | — | Conforming Steel |
| K | 0.0016 | 3.35 | 0.63 | 1.62 | 0.0021 | 0.0027 | 0.035 | 0.006 | — | 0.050 | 0.0006 | — | 0.0025 | — | Comparative Steel |
| L | 0.0035 | 3.32 | 0.58 | 1.60 | 0.0015 | 0.0014 | 0.005 | 0.004 | — | 0.052 | 0.0006 | — | — | 0.08 | Conforming Steel |
| M | 0.0045 | 4.02 | 0.25 | 0.12 | 0.0005 | 0.0007 | 0.009 | 0.015 | — | 0.012 | 0.00005 | — | — | — | Conforming Steel |
| N | 0.0023 | 3.35 | 1.51 | 0.25 | 0.0012 | 0.0009 | 0.015 | 0.025 | — | 0.120 | 0.0007 | — | 0.0045 | — | Conforming Steel |

"%" represents "mass %", and the balance is composed of Fe and inevitable impurities.

TABLE 4

| No. | Steel No. | Slab Heating Temp. (° C.) | Finishing Delivery Temperature (° C.) | Coiling Temperature (° C.) | Pickling Weight Loss after Hot Band Annealing ($g/m^2$) | Thickness of Cold Rolled Steel Sheet (mm) | $W_{10/400}$ (W/kg) | $B_{50}$ (T) | Surface Appearance | Remarks |
|---|---|---|---|---|---|---|---|---|---|---|
| 21 | I | 1100 | 870 | 590 | 55 | 0.30 | 14.9 | 1.68 | Poor | Comparative Example |
| 22 | J | 1100 | 870 | 590 | 22 | 0.30 | 13.9 | 1.69 | Good | Example |
| 23 | K | 1120 | 890 | 570 | 67 | 0.30 | 13.9 | 1.66 | Poor | Comparative Example |

TABLE 4-continued

| No. | Steel No. | Slab Heating Temp. (° C.) | Finishing Delivery Temperature (° C.) | Coiling Temperature (° C.) | Pickling Weight Loss after Hot Band Annealing ($g/m^2$) | Thickness of Cold Rolled Steel Sheet (mm) | $W_{10/400}$ (W/kg) | $B_{50}$ (T) | Surface Appearance | Remarks |
|---|---|---|---|---|---|---|---|---|---|---|
| 24 | L | 1120 | 890 | 570 | 29 | 0.30 | 13.0 | 1.67 | Good | Example |
| 25 | J | 1170 | 900 | 600 | 39 | 0.25 | 12.8 | 1.67 | Poor | Comparative Example |
| 26 | J | 1140 | 840 | 590 | 27 | 0.25 | 12.2 | 1.68 | Good | Example |
| 27 | L | 1030 | 830 | 530 | 38 | 0.25 | 11.9 | 1.66 | Poor | Comparative Example |
| 28 | L | 1060 | 880 | 550 | 25 | 0.25 | 11.3 | 1.67 | Good | Example |
| 29 | M | 1100 | 870 | 590 | 11 | 0.25 | 11.7 | 1.68 | Good | Example |
| 30 | N | 1100 | 870 | 540 | 30 | 0.25 | 11.0 | 1.67 | Good | Example |
| 31 | J | 1120 | 850 | 570 | 23 | 0.20 | 10.6 | 1.67 | Good | Example |
| 32 | N | 1080 | 890 | 590 | 30 | 0.20 | 9.7 | 1.66 | Good | Example |

Table 4 shows the values of pickling weight loss after subjecting the steel sheets to hot band annealing at 1000° C. for 30 seconds and then immersing them in a solution of 7% HCl at 80° C. for 60 seconds, and all of our examples were in the range of 10 $g/m^2$ or more and 35 $g/m^2$ or less.

Further, it is clear that our examples obtained under the production conditions of the hot-rolled steel sheet according to this disclosure all show good results in both magnetic properties and surface appearance.

The invention claimed is:

1. A hot-rolled steel sheet for producing a non-oriented electrical steel sheet, the hot-rolled steel sheet having a chemical composition consisting of, by mass %:

C: 0.005% or less;
Si: 2.0% or more and 4.5% or less;
Al: 0.2% or more and 2.0% or less;
Mn: 0.1% or more and 2.0 or less;
S: 0.003% or less;
N: 0.003% or less;
P: 0.015% or less;
Mo: 0.002% or more and 0.03% or less;
Pb and Bi in a total of 0.0010% or less;
at least one of Sn and Sb in a total of 0.005% or more and 0.2% or less;
and
the balance Fe with inevitable impurities,
wherein the hot-rolled steel sheet has a pickling weight loss of 10 $g/m^2$ or more and 35 $g/m^2$ or less under conditions of being (i) annealed in nitrogen atmosphere at 1000° C. for 30 seconds, and (ii) then immersed in a solution of 7% HCl at 80° C. for 60 seconds.

2. A method of producing a hot-rolled steel sheet for producing a non-oriented electrical steel sheet, the method comprising:

heating a slab having a chemical composition consisting of, by mass %:
C: 0.005% or less;
Si: 2.0% or more and 4.5% or less;
Al: 0.2% or more and 2.0% or less;
Mn: 0.1% or more and 2.0 or less;
S: 0.003% or less;
N: 0.003% or less;
P: 0.015% or less;
Mo: 0.002% or more and 0.03% or less;
Pb and Bi in a total of 0.0010% or less;
at least one of Sn and Sb in a total of 0.005% or more and 0.2% or less;
and
the balance Fe with inevitable impurities;
then subjecting the slab to hot rolling to obtain a hot-rolled steel sheet; and
then coiling the hot-rolled steel sheet,
wherein the slab heating temperature is 1050° C. or higher and 1150° C. or lower, and the finishing delivery temperature of the hot rolling is 820° C. or higher and 920° C. or lower, and the coiling temperature after the hot rolling is 520° C. or higher and 620° C. or lower.

3. A hot-rolled steel sheet for producing a non-oriented electrical steel sheet, the hot-rolled steel sheet having a chemical composition consisting of, by mass %:

C: 0.005% or less;
Si: 2.0% or more and 4.5% or less;
Al: 0.2% or more and 2.0% or less;
Mn: 0.1% or more and 2.0 or less;
S: 0.003% or less;
N: 0.003% or less;
P: 0.015% or less;
Mo: 0.002% or more and 0.03% or less;
Pb and Bi in a total of 0.0010% or less;
at least one of Sn and Sb in a total of 0.005% or more and 0.2% or less;
at least one element selected from the group consisting of Ca: 0.001% or more and 0.005% or less, Mg: 0.0002% or more and 0.005% or less, and Cr: 0.05% or more and 0.5% or less; and
the balance Fe with inevitable impurities,
wherein the hot-rolled steel sheet has a pickling weight loss of 10 $g/m^2$ or more and 35 $g/m^2$ or less under conditions of being (i) annealed in nitrogen atmosphere at 1000° C. for 30 seconds, and (ii) then immersed in a solution of 7% HCl at 80° C. for 60 seconds.

* * * * *